US008156581B2

(12) United States Patent
Fogleman

(10) Patent No.: US 8,156,581 B2
(45) Date of Patent: Apr. 17, 2012

(54) APPARATUS FOR LIFTING AND MOVING A PERSON

(76) Inventor: Boyd Carned Fogleman, Whitsett, NC (US)

( * ) Notice: Subject to any disclaimer, the term of this patent is extended or adjusted under 35 U.S.C. 154(b) by 0 days.

(21) Appl. No.: 13/048,531

(22) Filed: Mar. 15, 2011

(65) Prior Publication Data

US 2011/0227379 A1 Sep. 22, 2011

Related U.S. Application Data

(60) Provisional application No. 61/340,412, filed on Mar. 18, 2010.

(51) Int. Cl.
*A61G 7/10* (2006.01)

(52) U.S. Cl. ..... 5/83.1; 5/87.1; 297/312

(58) Field of Classification Search ..... 5/81.1 R, 5/83.1, 85.1–87.1; 297/312, 411.41
See application file for complete search history.

(56) References Cited

U.S. PATENT DOCUMENTS 2,747,652 A * 5/1956 Marsh ..... 297/344.16
2,792,052 A 5/1957 Johannesen
2,854,673 A * 10/1958 De Witt Ramsey ..... 5/86.1
2,962,730 A * 12/1960 Carnes et al. ..... 5/86.1
3,940,808 A 3/1976 Petrini
4,704,749 A 11/1987 Aubert
4,719,655 A * 1/1988 Dean ..... 5/86.1
5,148,559 A 9/1992 Morris
5,201,377 A 4/1993 Wilson
5,257,425 A 11/1993 Shinabarger
5,405,187 A * 4/1995 Soderlund ..... 297/312
6,748,612 B1 6/2004 Cerne et al.
6,934,980 B2 8/2005 Harney
6,974,142 B1 12/2005 Shikinami et al.
7,003,820 B1 * 2/2006 Iura et al. ..... 5/83.1
7,328,467 B2 2/2008 Aarestad

FOREIGN PATENT DOCUMENTS

GB 2017014 A 9/1979
JP 11137615 5/1999

* cited by examiner

*Primary Examiner* — Michael Trettel
(74) *Attorney, Agent, or Firm* — Michael G. Johnston; Moore & Van Allen PLLC

(57) ABSTRACT

An apparatus for lifting and moving a person comprises a mobile base assembly and a lift assembly moveably mounted on the base assembly permitting the lift assembly to move upwardly and downwardly relative to the base assembly. The lift assembly includes a frame member moveably engaging the base assembly. A first support arm of a butterfly seat is rotatably attached to the frame member for rotation about an upwardly extending axis. A second support arm of the butterfly seat is rotatably attached to the frame member laterally spaced from the first support arm for rotation about an upwardly extending axis. The first and second support arms include weight bearing platforms adjacent the free distal ends of the support arms. The first and second support arms are movable between a first position where the weight bearing platforms are close enough for supporting a person and a second position where the first support arm and the second support arm are spaced sufficiently from each other to receive a person between the weight bearing platforms. A powered lift is provided for moving the lift assembly upwardly and downwardly relative to the base assembly.

14 Claims, 13 Drawing Sheets

APPARATUS FOR LIFTING AND MOVING A PERSON

CROSS-REFERENCES

This application is related to U.S. provisional application No. 61/340,412, filed Mar. 18, 2010, entitled "Scooter With The Butterfly Seat", naming Boyd Fogleman as the inventor. The contents of the provisional application are incorporated herein by reference in their entirety, and the benefit of the filing date of the provisional application is hereby claimed for all purposes that are legally served by such claim for the benefit of the filing date.

BACKGROUND

This invention relates to a lifting and moving apparatus for transporting a person with reduced mobility from one location, such as a bed or chair, to another location such as a chair or commode, and vice versa.

Hospitals, care facilities and individuals who provide care and assistance to persons with reduced mobility continue to primarily rely on physical methods for lifting a person to transfer the person from a bed to a commode or other locations and back again. Physical methods for lifting and transferring a person represent significant risks of injury to both the person being carried and the care provider. The physical demands on care providers and the daily wear and tear on their bodies may contribute to high levels of attrition of nursing staff and other care providers in the health care field and contribute to the overall shortage of such providers.

The absence of a suitable mechanical method for lifting and moving a person may also require a person to move in to care facilities, despite having a spouse, child or other at home care provider who is willing to take care of the person, but is unable to physically lift the person to transfer the person from a bed to commode or other location.

Previous efforts to provide for a mechanical method for lifting and moving persons with reduced mobility have resulted in either complicated devices that are expensive and difficult to operate or overly simplistic devices that do not provide a complete solution for lifting and moving the person. Complicated and expensive devices create a barrier for use due to budgetary or insurance restrictions and may not be suitable for operation by the person or care provider who is not trained to operate the device. Simpler devices may be operable by the person or care provider, but if multiple devices are required to perform all of the functions necessary for independent living, the resulting costs may also be prohibitive. Moreover, many lifting and transfer devices require a person to be ambulatory or have a significant degree of upper body strength to utilize the device.

Additionally, conventional attempts to provide for a mechanical device for lifting and transferring persons are not well suited to persons of varying body types. While some of the conventional devices can be adapted to be used by bariatric persons, they do not provide for a simple mechanism allowing the device to be used for large persons at one moment and then immediately used for a smaller person.

For the foregoing reasons, there is a need for a lifting and moving apparatus for a person. The lifting and moving apparatus should be operable by trained, or untrained, care providers and enable the safe and efficient movement of a person from one location to another.

SUMMARY

An embodiment of an apparatus for lifting and moving a person comprises a base assembly, which may include a plurality of rollers for rolling movement of the base assembly. A lift assembly is moveably mounted on the base assembly permitting the lift assembly to move upwardly and downwardly relative to the base assembly. The lift assembly includes a frame member moveably engaging the base assembly. A first support arm of a butterfly seat is rotatably attached to the frame member for rotation about an upwardly extending axis. The first support includes a weight bearing platform that is attached adjacent a free distal end of the first support arm. The second support arm of the butterfly seat is rotatably attached to the frame member laterally spaced from the first support arm for rotation about an upwardly extending axis. The second support includes a weight bearing platform that is attached adjacent a free distal end of the second support arm. The first and second support arms are movable between a first position where the weight bearing platforms are close enough for supporting a person and a second position where the first support arm and the second support arm are spaced sufficiently from each other to receive a person between the weight bearing platforms. The lifting and moving apparatus also includes means for moving the lift assembly upwardly and downwardly relative to the base assembly.

BRIEF DESCRIPTION OF THE DRAWINGS

For a more complete understanding of the present invention, reference should now be had to the embodiments shown in the accompanying drawings and described below. In the drawings.

DESCRIPTION

Figure 12:
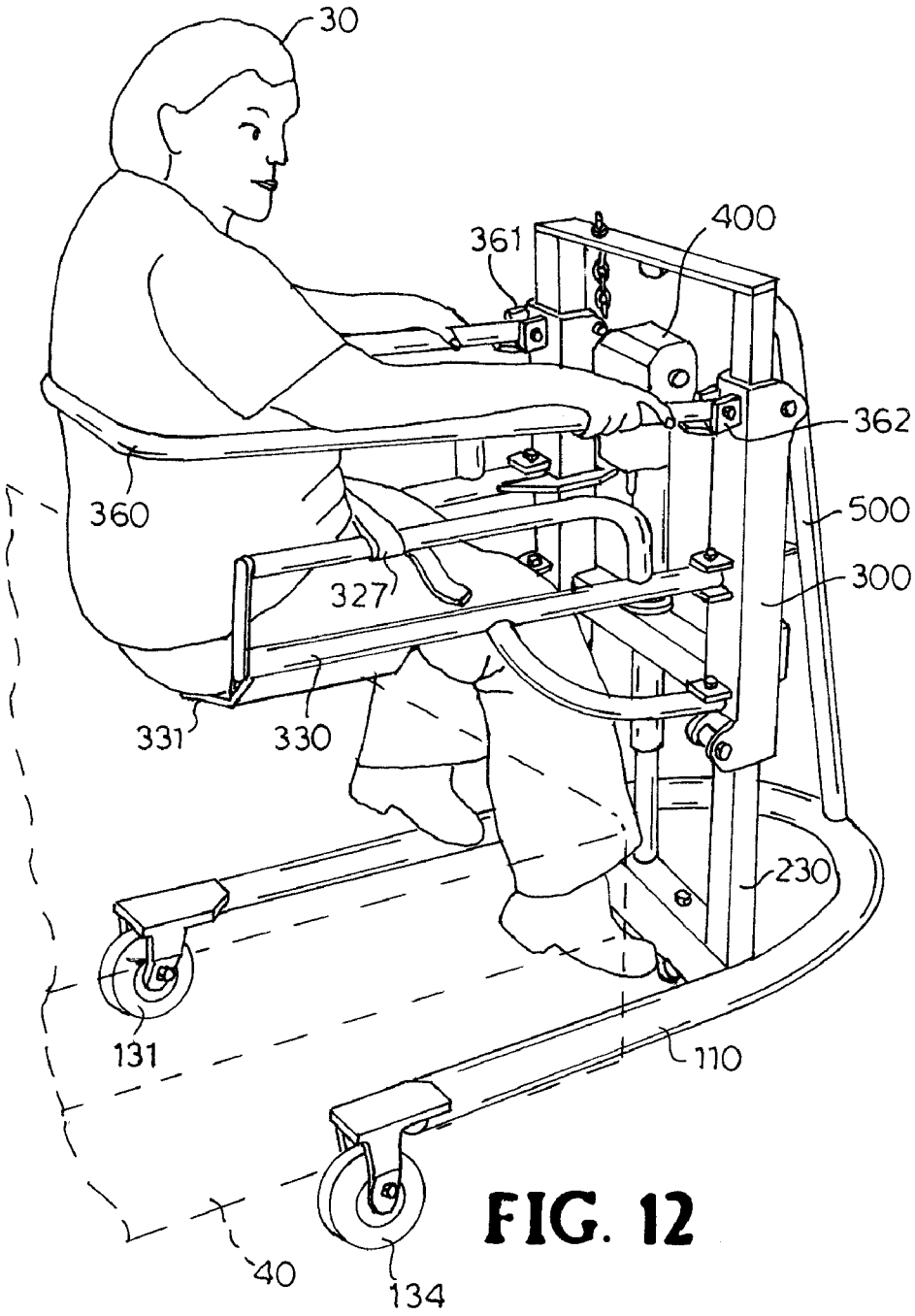
FIG. 12 is a right side perspective view of the apparatus for lifting and moving a person as shown in FIG. 1 with a person sitting in the apparatus.

Certain terminology is used herein for convenience only and is not to be taken as a limitation on the invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise. For convenience of reference "left" and "right," as used herein will refer to the person's left or right side as the person is seated on the apparatus as illustrated in FIG. 12. Further, for convenience "front," as used herein, will refer to the side of the apparatus facing the person as the person is seated on the apparatus as illustrated in FIG. 12 and "rear" will refer to the side of the apparatus not facing the person while the person is seated on the apparatus.

Referring now to the drawings, wherein like reference numerals designate corresponding or similar elements throughout the several views, an apparatus for lifting and moving a person, is shown in FIGS. 1-8, and generally designated at 20. The lifting and moving apparatus 20 comprises a rolling base assembly 100 including an upper frame assembly 200, a lift assembly 300 moveably mounted on the upper frame assembly 200, and a powered lift mechanism 400 for moving the lift assembly 300 upwardly and downwardly relative to the upper frame assembly 200.

All of the components of the apparatus for lifting and moving a person 20 can be made from high tensile steel unless otherwise indicated. It will be understood that the components may also be made of any other material of sufficient rigidity and strength to support a person.

Figure 7:
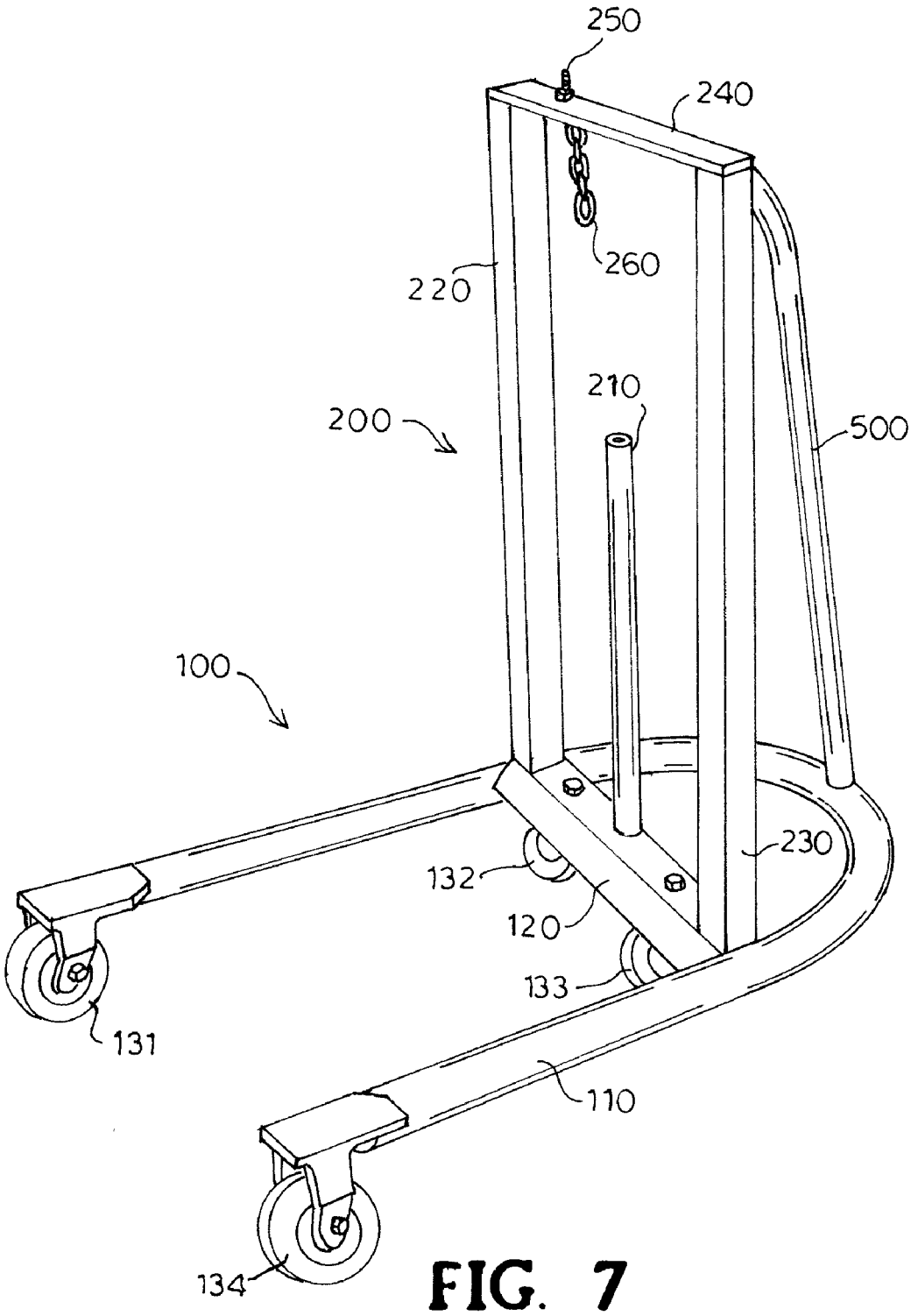
FIG. 7 is a right side perspective view of a base assembly for use with the apparatus for lifting and moving a person as shown in FIG. 1.

As best seen in FIG. 7, the base assembly 100 comprises a u-shaped lower frame member 110, the upper frame assembly 200, a support plate 120 joining the legs of the lower frame member 110 adjacent to the closed end of the lower frame member 110, and a plurality of wheels 131 affixed to the lower frame member for rolling movement of the base assembly 100. The open end of the lower frame member 110 is at least wide enough to admit a standard wheel chair. Preferably, the largest span of the legs of the lower frame member 110 should not exceed the width of a standard door frame. The ends of the support plate 120 are attached to opposite legs of the lower frame member 110. The support plate 120 serves as foundation for the upper frame assembly 200. In the embodiment of the lifting and moving apparatus shown in the Figures, two wheels, 132, 133, are affixed beneath the support plate 120 and one wheel is affixed beneath the distal end of each leg of the lower frame member 110. The wheels 132 are mounted on swivel mounts for free rotation to facilitate ease in directing the movement of the lifting and moving apparatus. The wheels may include conventional wheel locks (not shown) to secure the lifting and moving apparatus at a location.

It is understood that the base assembly 100 may take other forms and include additional or fewer wheels. For instance, the base assembly 100 in some embodiments may include an H-shaped lower frame member, including two legs and a cross-piece, and feature wheels affixed at the distal and proximal ends of each of the legs and one or more wheels affixed to the cross piece of the lower frame member. Regardless of form, the base assembly 100 must provide sufficient structure to support the other elements of the lifting and moving apparatus 20 and must facilitate the movement of the apparatus 20 from one location to another.

In one embodiment of the apparatus for lifting and moving a person, the lifting and moving apparatus 20 will also feature a drive motor (not shown) for imparting rotation to at least one of the wheels for powered movement of the lifting and moving apparatus. The drive motor may be secured to the base assembly 100 and operatively connected to one or more of the plurality of wheels 131. Power to the drive motor may be provided by a conventional electrical power source, such as a 12-volt automobile battery. The drive motor can be actuated by a control mechanism preferably attached to the lift assembly 300. The control mechanism may include any suitable means for controlling the drive motor, such as a joystick, lever, switch or digital control panel. In one embodiment, the controlling means may be positioned to enable the person 30 being lifted and moved to independently self-direct and control the operation of the lifting and moving apparatus 20.

Referring to FIG. 7, the upper frame assembly 200 is anchored to the base assembly 100. The upper frame assembly 200 comprises an upwardly extending lift shaft 210, two upwardly extending support posts 220,230 and a crossbar 240. The lift shaft 210 is attached at a lower end to the midpoint of the support plate 120. The lower ends of the support posts, 220,230, are attached to the base assembly 100 at the junctions of the ends of the support plate 120 and the legs of the lower frame member 110. The support posts 220, 230 are substantially identical. The crossbar 240 is attached to the top of the upper ends of the support posts 220,230.

Figure 6:
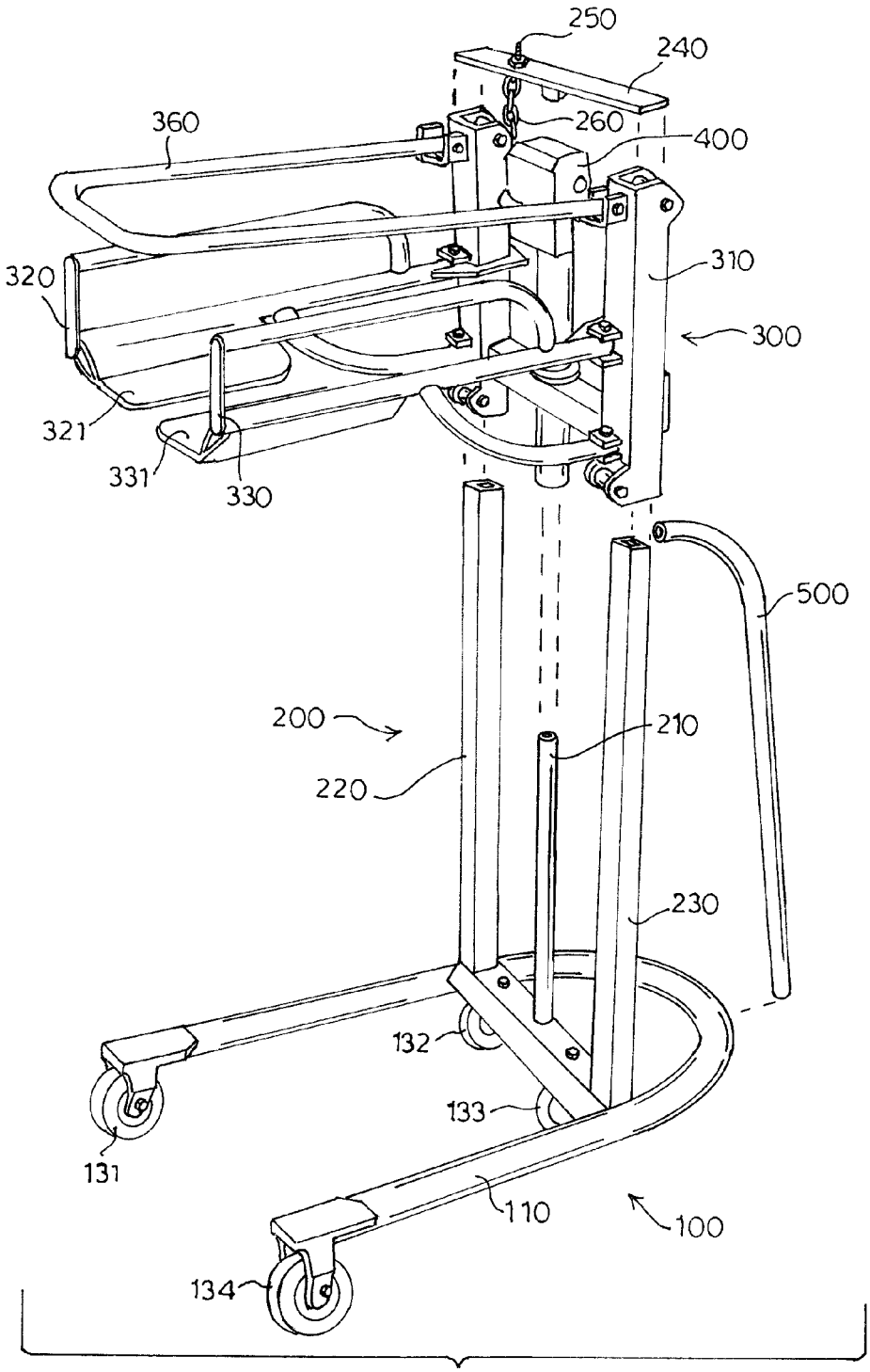
FIG. 6 is a partially exploded right side perspective view of the apparatus for lifting and moving a person as shown in FIG. 1.
Figure 8:
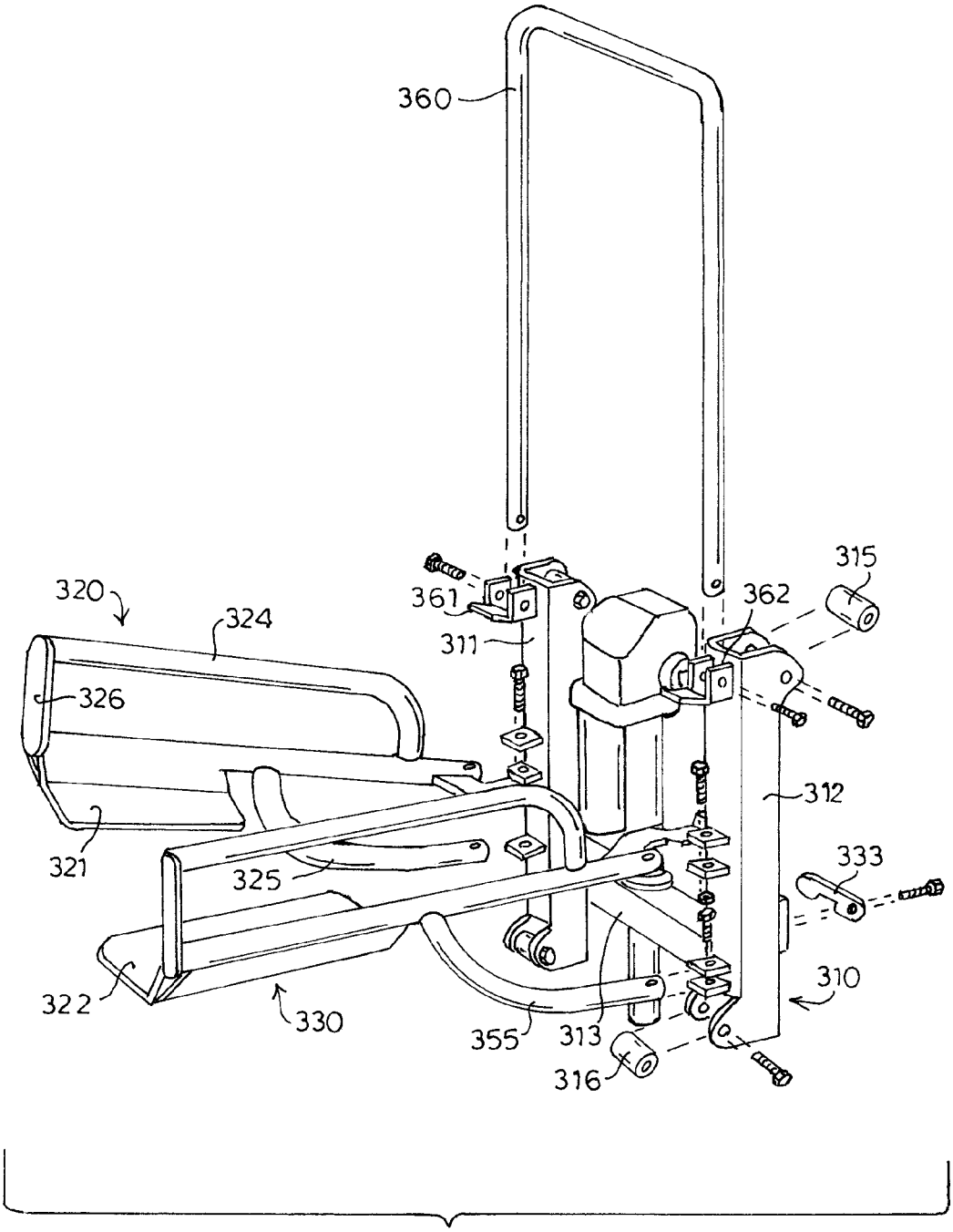
FIG. 8 is an exploded right side perspective view of a lift assembly for use with the apparatus for lifting and moving a person as shown in FIG. 1.

Referring to FIGS. 6 and 8, the lift assembly comprises a frame member 310, a butterfly seat comprising a left support arm and a right support arm 320,330, latching mechanisms 340, 350 for each support arm 320,330 and a safety bar 360.

The frame member 310 is substantially H-shaped, comprising left and right C-shaped support members 311,312 joined intermediate their ends by a support bar 313. The support members, 311,312 include guide rollers 315,316 at their ends. In one embodiment of the apparatus for lifting and moving a person 20, a guide roller 315 is operably attached to the rear of each support member 311,312 adjacent the upper ends of the support members. Another guide roller 316, is operably attached to the front of each support member 311, 312 adjacent the lower ends of the support members.

Figure 1:
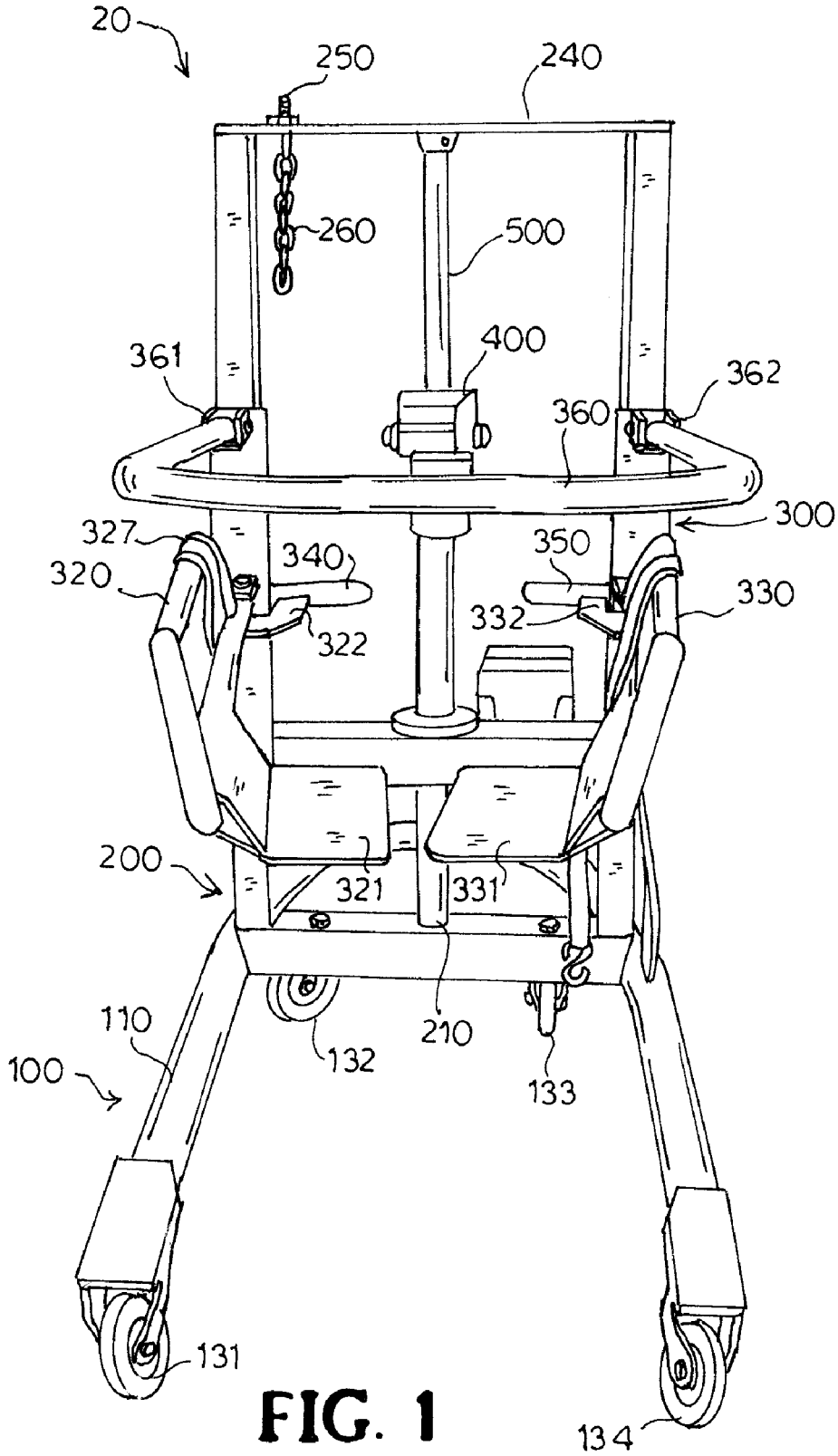
FIG. 1 is a front perspective view of an embodiment of an apparatus for lifting and moving a person.
Figure 2:
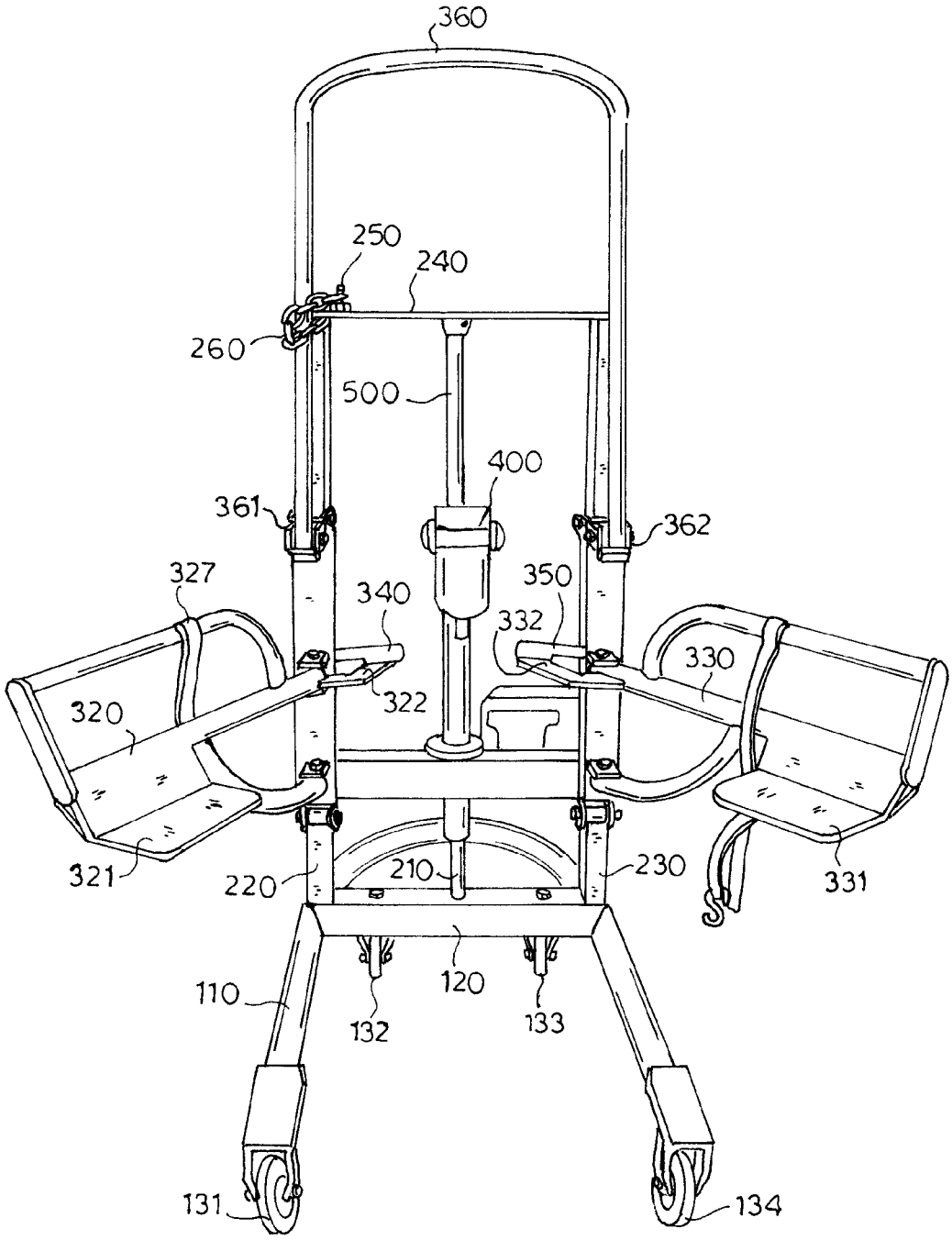
FIG. 2 is a front perspective view of the apparatus for lifting and moving a person as shown in FIG. 1 with a safety bar raised and first and second support arms rotated outwardly.
Figure 9A:
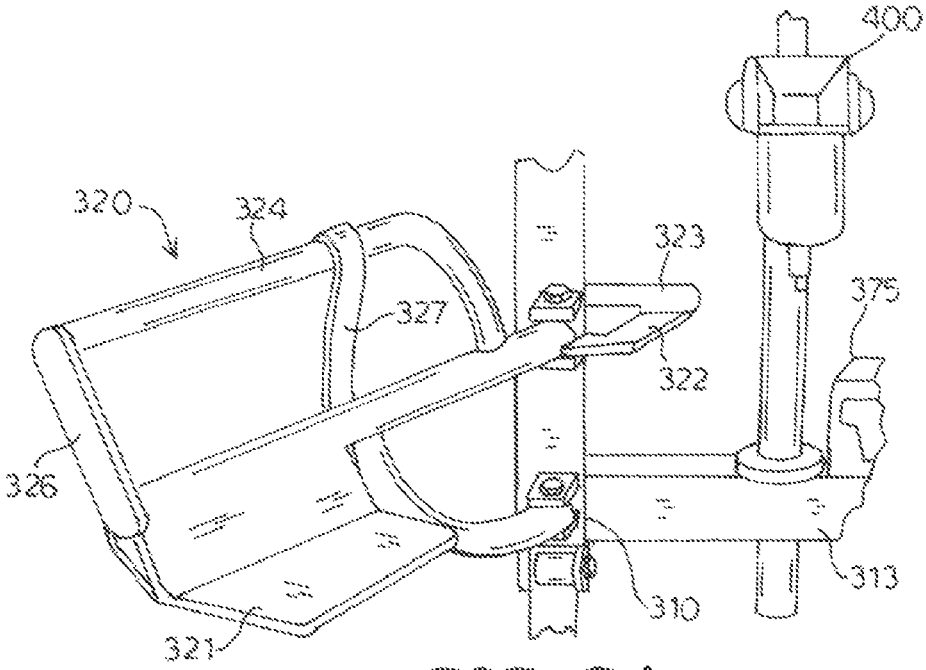
FIG. 9A is a close-up front perspective view of a portion of a lift assembly for use with the apparatus for lifting and moving a person as shown in FIG. 2.
Figure 9B:
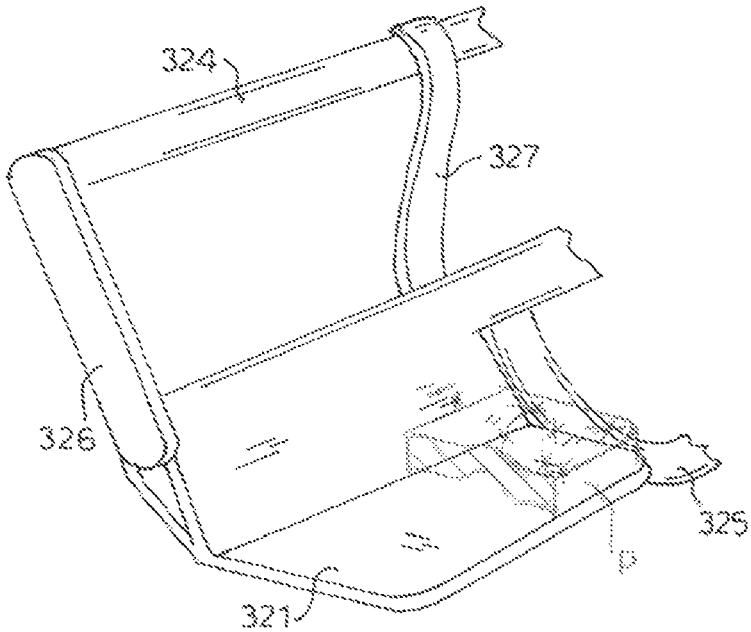
FIG. 9B is a close-up front perspective view of a weight bearing platform and other components of a first support arm for use with the apparatus for lifting and moving a person as shown in FIG. 9A.

The proximal ends of each of the left and right support arms 320,330 are rotatably attached to the support members 311, 312. As shown in FIGS. 9A and 9B, the distal ends of the support arms 320,330 each further comprise a cantilevered weight bearing platform 321,331. The weight bearing platforms 321,331 are at least long enough to support the buttocks, and in some embodiments the legs or prone body, of persons of different sizes. A removable padded cover P may be provided for covering the weight bearing platforms, 321, 331 for increasing the comfort of the person 30 supported in the lifting and transferring apparatus 20. As best seen in FIGS. 1 and 2, the support arms 320,330 can be rotated outwardly from a first position substantially parallel to each other to a second position where the distal ends of the support arms 320,330 and thus the platforms 321,331, are spaced apart from each other.

Figure 10A:
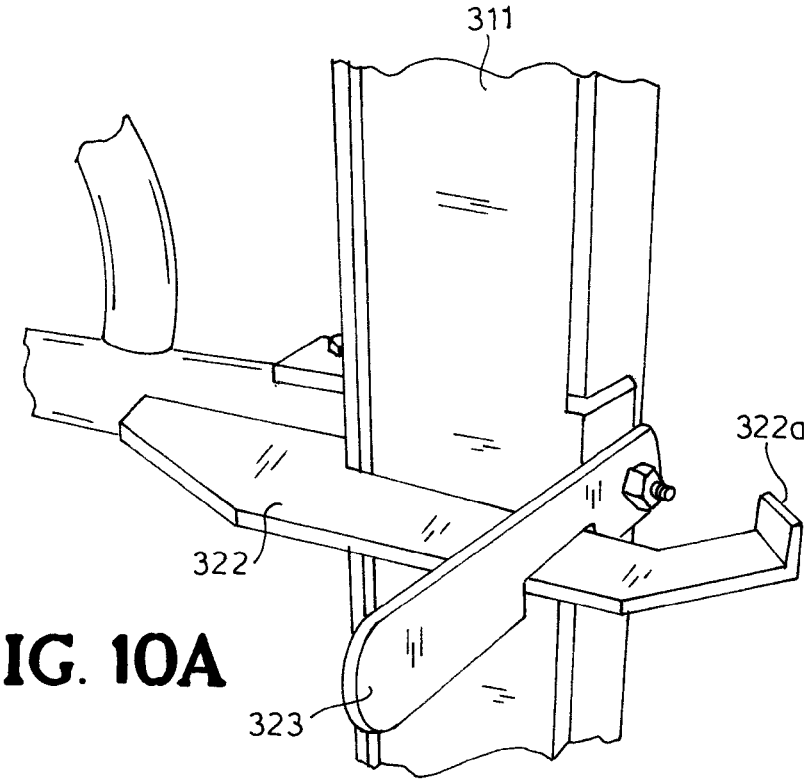
FIG. 10A is a close-up perspective view of an embodiment of a latching means for use with the apparatus for lifting and moving a person as shown in FIG. 1, showing the latching means in a first position.
Figure 10B:
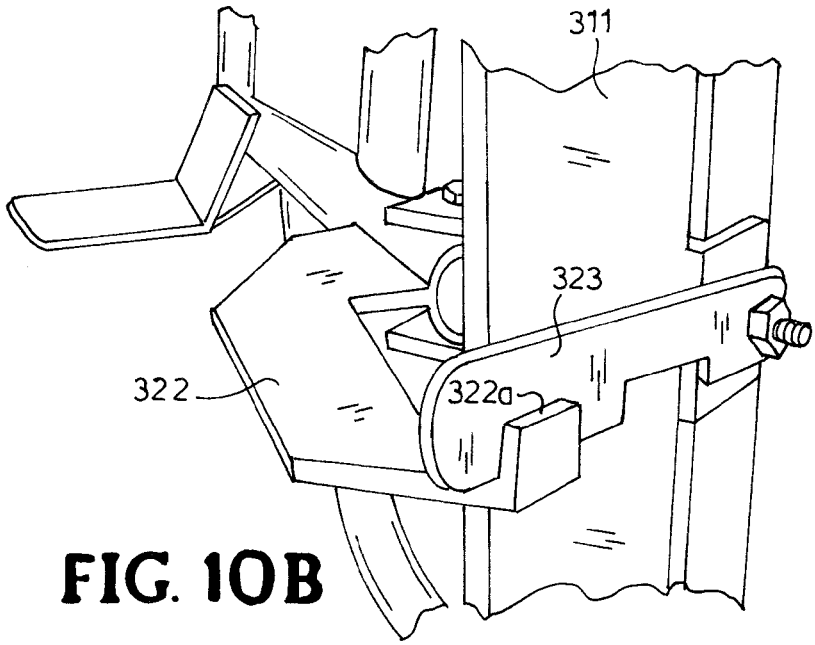
FIG. 10B is a close-up perspective view of the latching means as shown in FIG. 10A showing the latching means in a second position.

Referring to FIGS. 10A and 10B, a restricting member 322 is integral with the proximal end of each of the support arms 320,330 adjacent to the frame member 310. Each restricting member 322 is a C-shaped plate and extends forwardly from the end of each support arm 320,300 and beyond the support members 311,312. The ends of each restricting member include an upwardly projecting lip 322*a*. As best seen in FIG. 10B, the outer edges of the restricting members 322 define a rectangular notch for receiving the adjacent support member 311 when the support arm 320 is in the first position. The restricting member 322 permits the support arm 320 to rotate unobstructed to the second position. A latch 323 is pivotally mounted on the rear of each support member 311, 312. The latch 323 defines a notch along a bottom edge that is slightly larger in width than the restricting member 322. The length of the latch 323 and the connecting point at the proximal end of the latch 323 is such that the latch freely rotates in a downward manner relative to the upper frame assembly 200 unless acted upon by an opposite force. As shown in FIG. 10A, when the support arm 320 is in the first position the notch in the latch 323 receives the restricting member 322, engaging the restricting member 322 and preventing the support arm 320 from rotating from the first position. Referring to FIG. 10B, when the support arm 320 rotates to the second position, the latch 323 encounters the lip 322*a* of the restricting member 322 and restricts the support arm 320 from rotating further.

Referring to FIGS. 8 and 9A, the support arms 320 may also include side rails 324 and lower braces 325 for providing increased stability, support and weight bearing capability to the support arms 320. The side rails 324 are L-shaped and one end of each side rail 324 is fixed to the support arm 320 adjacent to the frame member 310. The side rail 324 terminates above the end of the support arm 320 and is attached to the end of the support arm 320 by a plate 326 welded between the ends of the support arm 320 and the side rail 324. The lower braces 324 are pivotally attached at one end to the frame member 310 below the support arm. The other end of the lower brace is attached medially to the support arm 320.

As best shown in FIG. 2, the lifting and moving apparatus may also feature a conventional safety strap 327. The safety strap 327 is comprised of two straps, one strap connected to each support arm 320,330 or in certain embodiments, to the side rails 324,334, each strap featuring a mechanism for connecting to the other strap.

Figure 4:
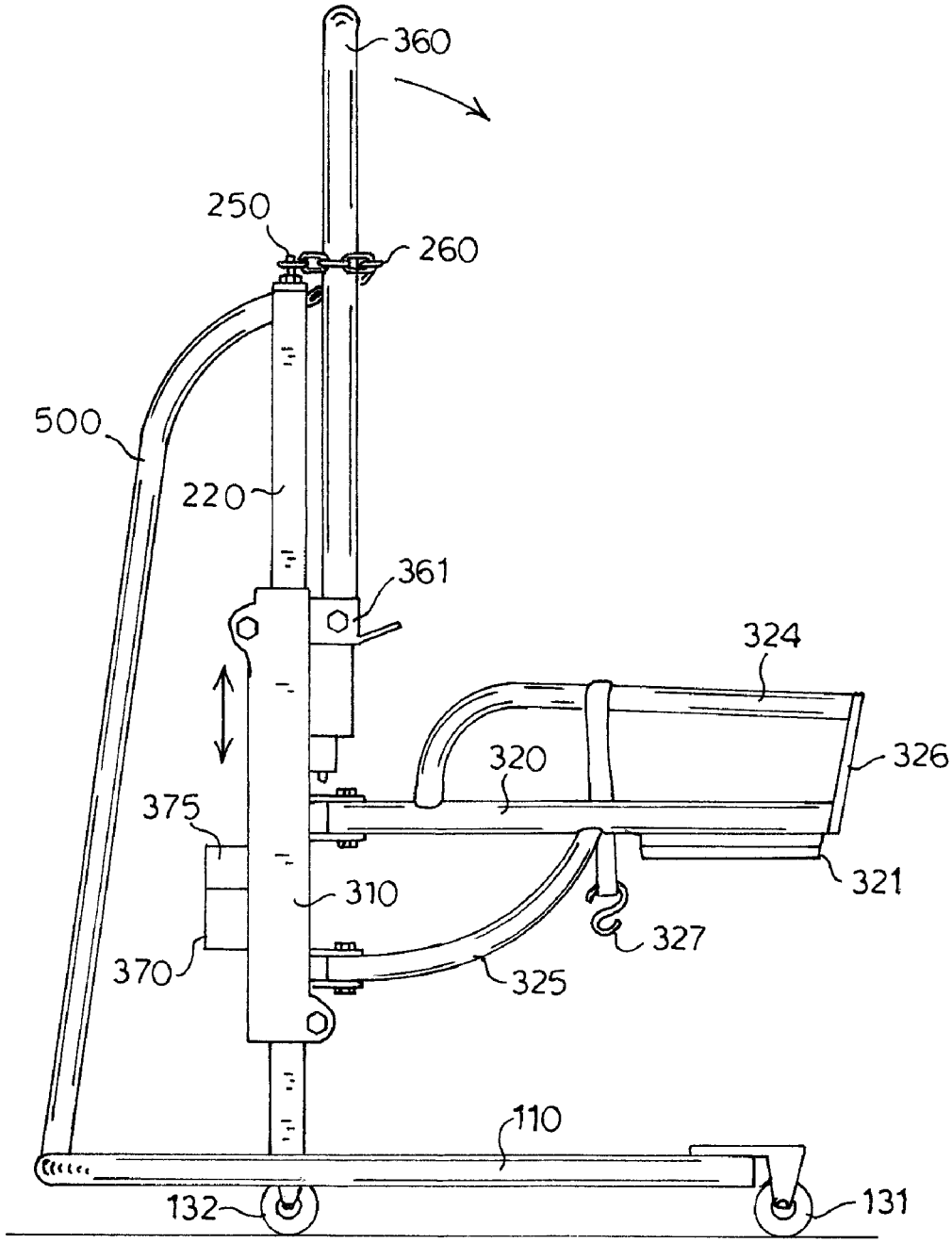
FIG. 4 is a left side elevation view of the apparatus for lifting and moving a person as shown in FIG. 1 with a safety bar in a raised position.
Figure 5:
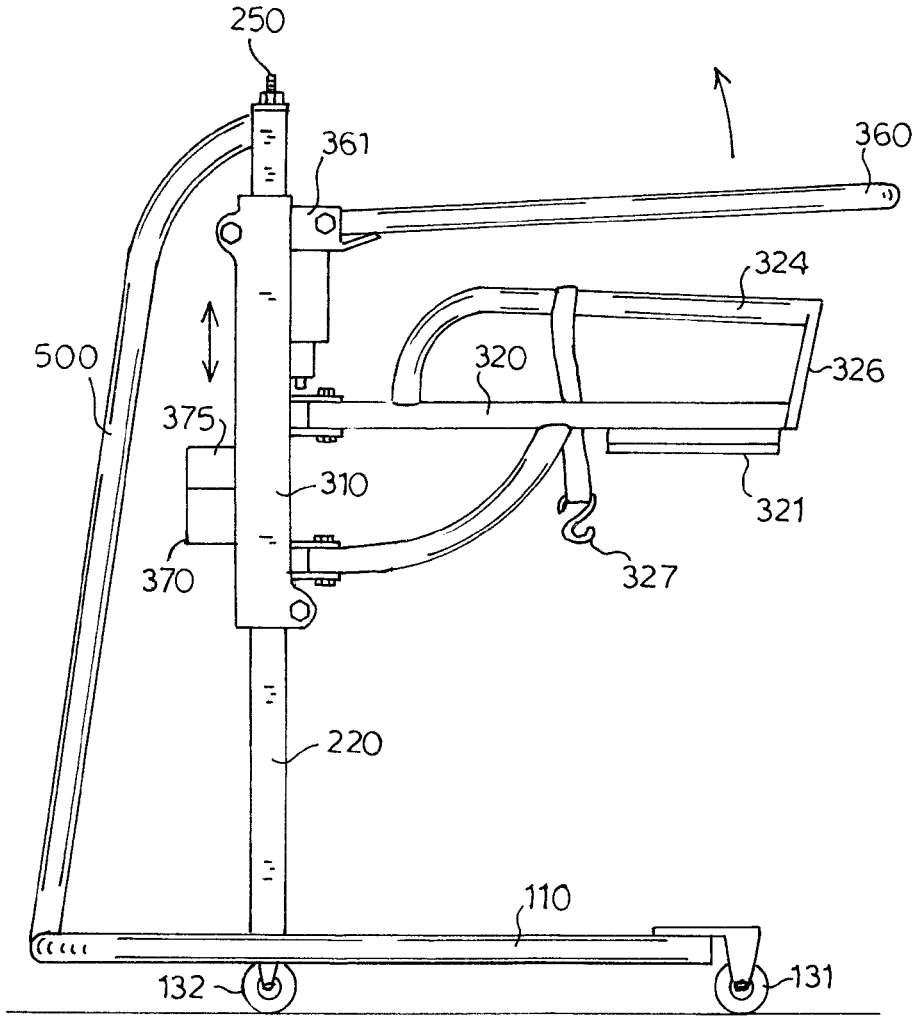
FIG. 5 is a left side elevation view of the apparatus for lifting and moving a person as shown in FIG. 1 with a lift assembly in a raised position and a safety bar in a down position.

Referring to FIG. 8, the safety bar 360 is u-shaped and the ends of the safety bar 360 are rotatably attached to the frame member 310 enabling the safety bar 360 to rotate from a first position substantially parallel to the upper frame assembly 200 (FIG. 4), to a second position where the safety bar 360 is in a plane substantially parallel to the support arms 320,330 (FIG. 5). As seen in FIGS. 2 and 4, when the safety bar 360 is in the first position it can be secured using a length of chain 260 attached to a rectangular plate 240 by wrapping the chain 260 around the safety bar 360 and sliding the unattached end of the chain 260 over the upwardly extending segment of a bolt 250. As shown in FIG. 8, a bolt attachment 361,362 connected at the bottom by a protruding ledge, is welded to the front of the support members 311, 312 near the top of each support member 311,312. The protruding ledge of each bolt attachment 361,362 supports the safety bar 360 and restricts the safety bar 360 from rotating past the second position.

Figure 3:
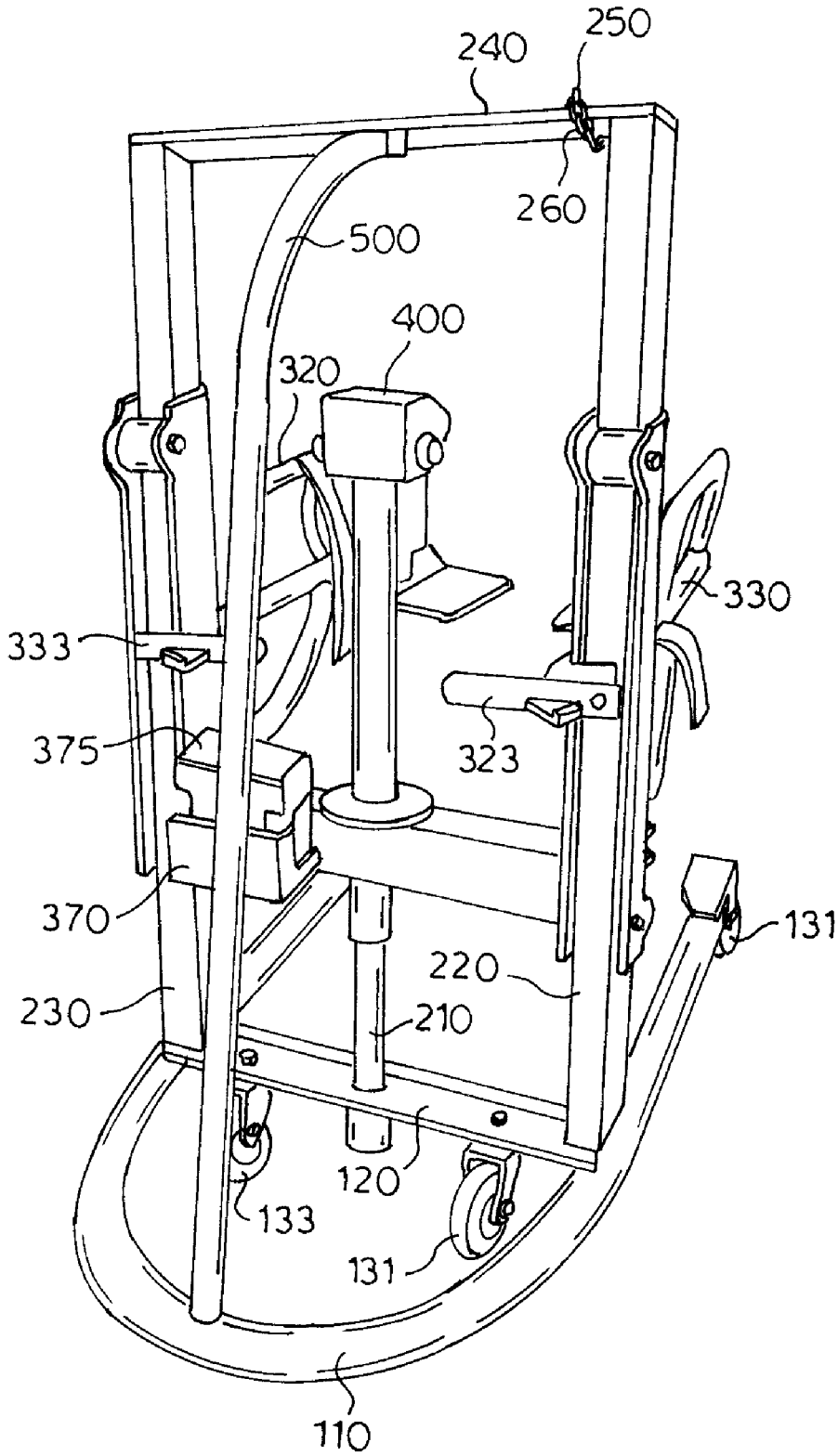
FIG. 3 is a rear perspective view of the apparatus for lifting and moving a person as shown in FIG. 1.

As best seen in FIG. 3, the lift assembly 300 will also include a mounting bracket 370 and a power source 375 for the lift 400. The mounting bracket 370 is attached to the back surface of the support bar 313. The lift 400 is a conventional screw motor assembly including a shaft that passes through an opening in the middle of the support bar 313. Such a lift is commercially available from Ultra-Fab Products, Inc., Elkhart, Ind. 46517 under Manufacturer's Number 38-944017. The shaft defines a bore for receiving and engaging the lift shaft 210 of the upper frame assembly 200 for powered upward and downward movement of the lift 400 and the connected lift assembly 300 relative to the lift shaft 210 and the connected base assembly 100. As seen in FIG. 9A, the lift 400 is secured to the support bar 313. The switch to operate the lift may be connected directly to the lift 400. In other embodiments of the invention the person 30 will be able to actuate the lift 400 by a control apparatus, such as a joystick, lever, switch or digital input panel connected to the support arm (not shown).

As best seen in FIG. 3, a brace 500 is fixed at one end to the top of the upper frame assembly 200 and on the other end to the base assembly 100.

As best shown in FIG. 6, the support members 311,312 of the lift assembly 300 moveably receive the support posts 220,230 of the base assembly 100 and the lift 400 receives the lift shaft 210. The lift shaft 210 facilitates the transfer of energy from the lift 400 to the lift assembly 300 and moves the lift assembly 300 upwardly and downwardly relative to the upper frame assembly 200. The guide rollers 315,316 facilitate the relative sliding motion of the lift assembly 300 along the upper frame assembly 200.

Figure 11:
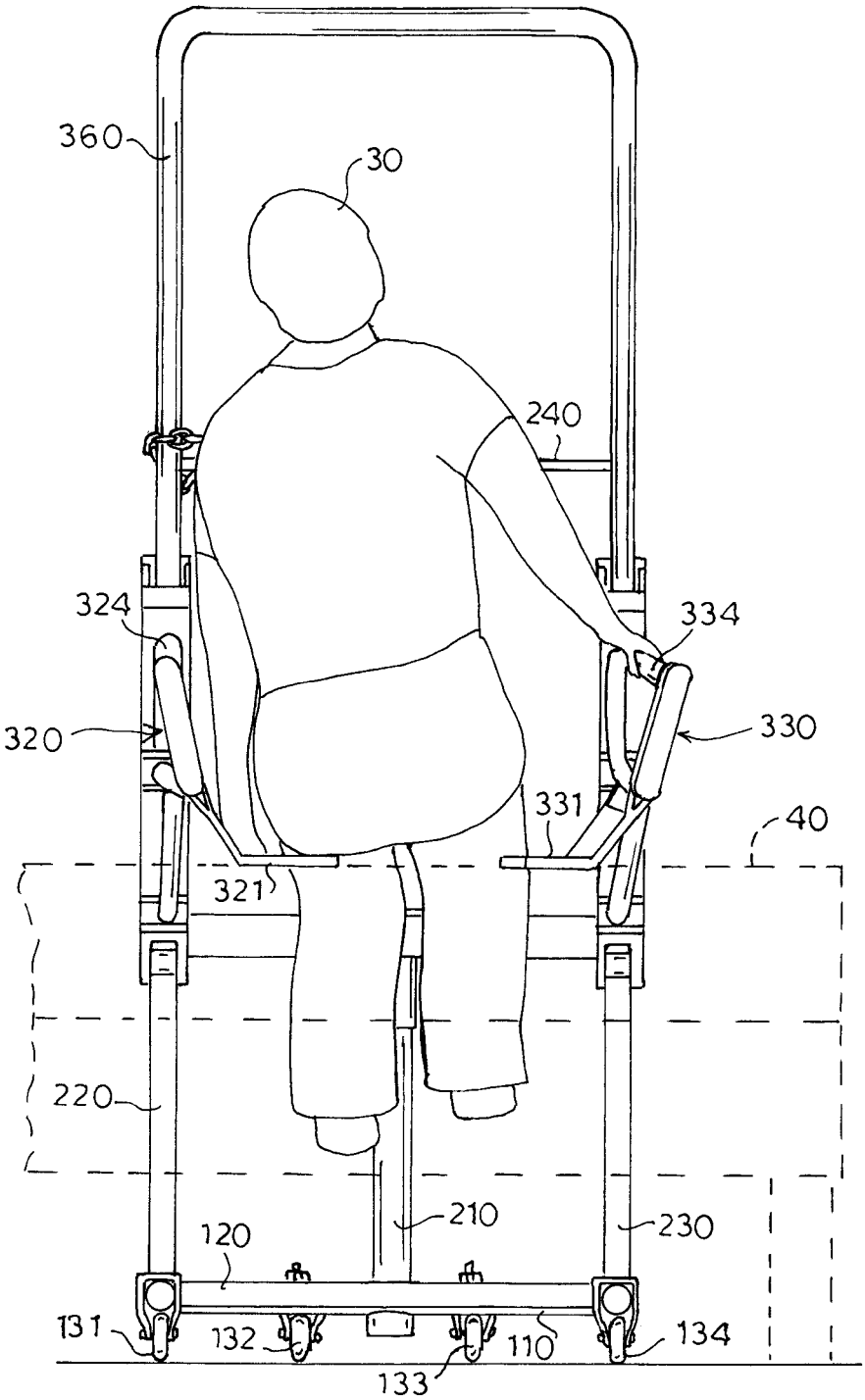
FIG. 11 is a front perspective view of a person using the apparatus for lifting and moving a person as shown in FIG. 1.

In use, the apparatus for lifting and moving a person 20 is rolled to a first location of the person 30. This location can include, but is not limited to any of the following a bed, chair, commode or wheelchair. As best shown in FIG. 11, if the person 30 is in a bed 40 the lifting and moving apparatus 20 is moved to the edge of the bed 40 with the legs of the u-shaped lower frame assembly 110 under the bed. The latches 323,333 are raised so that the movement of the support arms 320,330 is not restricted. The support arms 320,330 are rotated to the second position. The safety bar 360, if it is not already in the first position is rotated to the first position and secured using the chain 250. The lift 400 is actuated moving the lift assembly 300 upward or downward as necessary so the weight bearing platforms 321, 331 are adjacent with the surface of the bed 40. The person 30 sits up or is moved into a seated position on the bed. The person or the lifting and moving apparatus 20 is manipulated so that the person's legs are facing the apparatus. The person 30 grabs hold of the support arms 320,330. As seen in FIG. 11, the person 30 leans to a first side, either the left or the right, adjusting his or her weight primarily onto that side and rotates the opposite support arm 320 until the corresponding weight bearing platform 321 slides under the person's buttock and leg and the support arm 320 returns to the first position. The person 30 then leans in the other direction adjusting his or her weight primarily onto the second side and rotates the other support arm 330 until the corresponding weight bearing platform 331 slides under the person's other buttock and leg and the support arm 330 returns to the first position. As the support arms 320,330 rotate back to the first position, the notch in the latch 323, 333 engages the restricting member 322, 332 preventing the support arms 320,330 from rotating out of the first position until the latch 323, 333 is disengaged from the restricting member 322,332 (FIG. 10A). The safety bar 360 is released from the chain 250 and is rotated over the head of the person to the second position. The safety bar 360 prevents the person from sliding backwards off of the weight bearing platforms 321, 331 and provides a back rest and arm rests for the person 30, as seen in FIG. 12. The safety strap 327 is secured across the lap of the person preventing the person 30 from sliding forward off of the weight bearing platforms 321,331 and further restricting the rotation of the support arms 320,330. As best illustrated in FIG. 12, the lift 400 is actuated to raise the lift assembly 300 upwardly relative to the base assembly 200 to create some vertical separation between the person and the bed. The lifting and moving apparatus 20 is then moved by rolling from the first location to a second location, such as a chair commode etc., and the above described procedures are reversed. Any of the actions attributed to the person 30 may be performed by a care giver. In some embodiments of the lifting and moving apparatus 20, the person 30 will use a control mechanism to independently self-direct the powered rolling movement of the lifting and moving apparatus 20 and the upward and downward movement of the lift assembly 300.

One of the many advantages of the lifting and moving apparatus 20 is that the apparatus allows a person to be moved from one location to another without the need for a care giver to ever lift the person. With little to no assistance, a person with reduced mobility is able to maneuver himself or herself on to the lifting and moving apparatus to be transported to a different location. The person is secured within the apparatus by the safety bar 360, safety strap 327 and latches 323,333, ensuring the safety of the person throughout the transfer and avoiding the risk of injury inherent in being physically lifted by another person.

Figure 13:
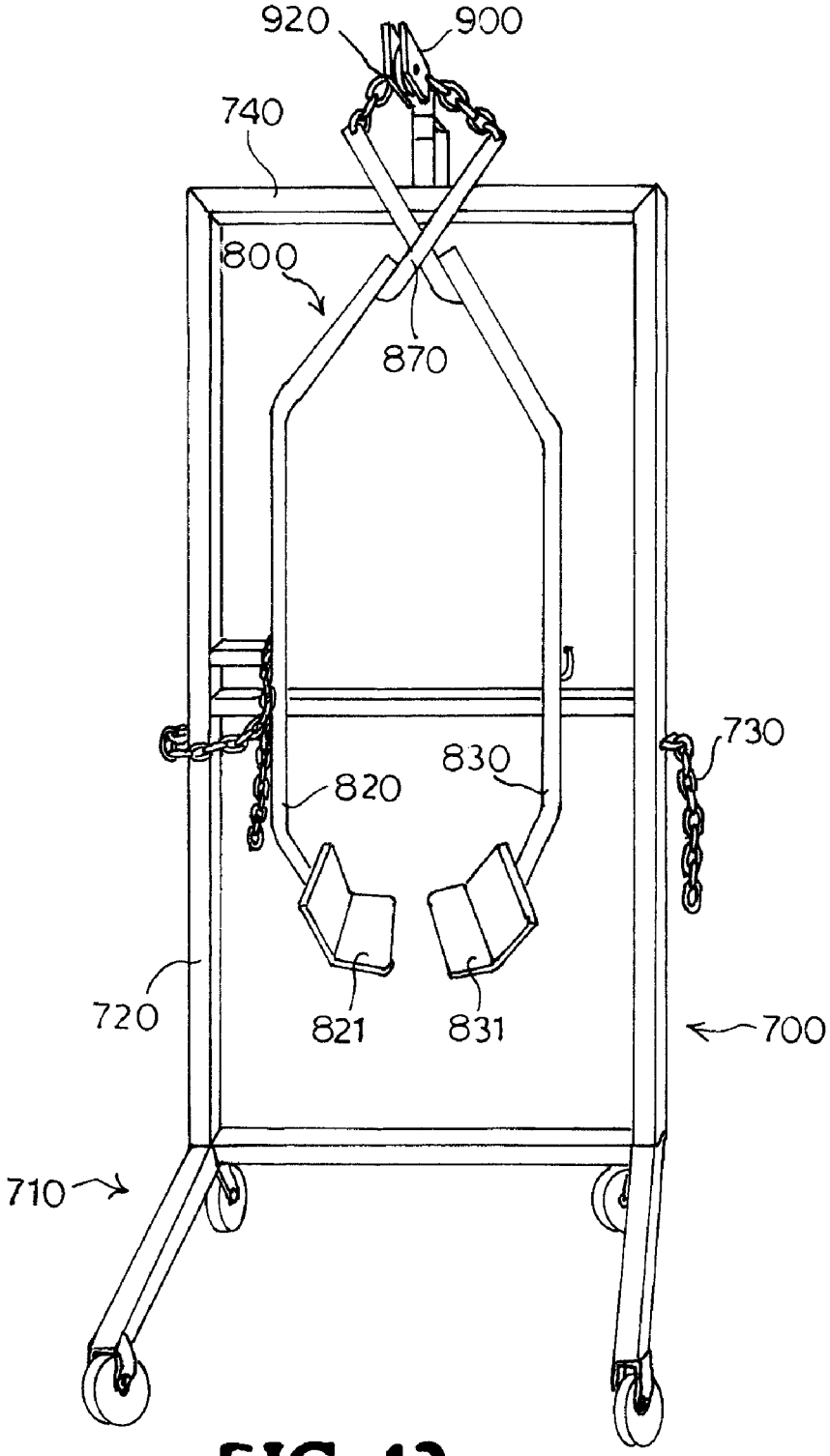
FIG. 13 is a front perspective view of an alternate embodiment of an apparatus for lifting and moving a person.

FIG. 13 shows an alternate embodiment of the lifting and moving apparatus, wherein a lift assembly 800 is moveably connected by means of a conventional pulley system 900 to a frame assembly 700. The lift assembly comprising a first support arm 820 and a second support arm 830. The first and second support arms 820,830 both feature a weight bearing platform 821,831 that is attached near the terminus of each support arm 820,830. The first and second support arms 820, 830 are hingedly connected to each other at a pivot point 870 adjacent the end of the support arms 820,830 opposite the weight bearing platforms 821,831. The first and second support arms 820,830 form a double-lever, moving toward or away from each other in a uniform manner.

The frame assembly 700 includes a base member 710 featuring a plurality of wheels, an upper frame member 720 secured to the base member 710 and a crossbeam 740 connected to the top of the upper frame member 720. A pulley system 900 is medially attached to the crossbeam 740. A cable or chain 920 operably passes through the pulley system 900 and is attached on one end to the lift assembly 800. The other end of the cable 920 is connected to a conventional winch (not shown). The operation of the winch causes the lift assembly 800 to move upwardly and downwardly relative to the upper frame member 720. Chains 730 are attached to the frame assembly 700 and can be connected to the lift assembly 800 to stabilize the lift assembly 800 and to prevent the lift assembly 800 from swinging while it moves upwardly and downwardly.

In use, the lift assembly 800 is lowered as necessary so the weight bearing platforms 821, 831 are adjacent with the surface of the bed 40. The person 30 sits up or is moved into a seated position on the bed. The person 30 spreads the support arms 820,830, leaning to a first side, either the left or the right, adjusting his or her weight primarily onto that side and allows the opposite support arm 820 to swing inward until the corresponding weight bearing platform 821 slides under the person's buttock and leg. The person 30 then leans in the other direction adjusting his or her weight primarily onto the second side and swings the other support arm 830 until the corresponding weight bearing platform 831 slides under the person's other buttock. The winch is actuated to raise the lift assembly 800 upwardly relative to the frame assembly 700 to create some vertical separation between the person and the bed for rolling from the first location to a second location, such as a chair commode etc., and the above described procedures are reversed. Any of the actions attributed to the person 30 may be performed by a care giver.

Although the present invention has been shown and described in considerable detail with respect to a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An apparatus for lifting and moving a person, the lifting and moving apparatus comprising:

(a) a mobile base assembly;

(b) a lift assembly moveably mounted on the base assembly, the lift assembly comprising (i) a frame member moveably engaging the base assembly, (ii) a first support arm rotatably attached to the frame member for rotation in a first plane about an upwardly extending axis, the first support arm including a weight bearing platform adjacent a free distal end of the first support arm, the weight bearing platform operatively connected for rotation with the first support arm in a second plane spaced below the first plane, and (iii) a second support arm rotatably attached to the frame member laterally spaced from the first support arm for rotation in the first plane about an upwardly extending axis, the second support arm including a weight bearing platform adjacent a free distal end of the second support arm, the weight bearing platform operatively connected for rotation with the second support arm in the second plane, and wherein the first support arm and the second support arm are rotatably movable between a first position where the weight bearing platforms are close enough for supporting a person and a second position where the first support arm and the second support arm are spaced sufficiently from each other for receiving the person between the weight bearing platforms; and (c) means for moving the lift assembly upwardly and downwardly relative to the base assembly.

2. A lifting and moving apparatus as recited in claim 1, further comprising a plurality of rollers operatively connected to the base assembly for rolling movement of the base assembly.

3. A lifting and moving apparatus as recited in claim 1, the base assembly comprising:

(a) a lower frame member including a support plate; and (b) an upper frame member attached to the support plate, the upper frame member comprising a first upwardly extending support post connected at one end to the support plate, a second upwardly extending support post connected at one end to the support plate laterally spaced from the first support post, a crossbar attached to the first and second support posts connecting the support posts, and a lift shaft attached to the support plate intermediate of the first and second support posts.

4. A lifting and moving apparatus as recited in claim 3, wherein a brace is attached at one end to the crossbar and at the other end to the lower frame member.

5. A lifting and moving apparatus as recited in claim 3, the frame member of the lift assembly further comprising a first support member and a second support member, each end of the support members including opposed ears on opposite sides of the respective support member, a support bar connecting the first and second support members, and rollers mounted between the pairs of opposed ears and defining a space between each roller and the associated first and second support members for receiving the first and second support posts, respectively, for movement of the frame member relative to the first and second support posts.

6. A lifting and moving apparatus as recited in claim 1, further comprising a latching mechanism attached to the lift assembly for securing the first and second support arms in the first position.

7. A lifting and moving apparatus as recited in claim 1, wherein the weight bearing platforms are covered with padding.

8. A lifting and moving apparatus as recited in claim 1, wherein the moving means comprises a power supply.

9. A lifting and moving apparatus as recited in claim 8, wherein the power supply is a battery.

10. An apparatus for lifting and moving a person, the lifting and moving apparatus comprising:

(a) a mobile base assembly;

(b) a lift assembly moveably mounted on the base assembly, the lift assembly comprising (i) a frame member moveably engaging the base assembly, (ii) a first support arm rotatable attached to the frame member for rotation about an upwardly extending axis, the first support arm including a weight bearing platform adjacent a free distal end of the first support arm, (iii) a second support arm rotatably attached to the frame member laterally spaced from the first support arm for rotation about an upwardly extending axis, the second support arm including a weight bearing platform adjacent a free distal end of the second support arm, and (iv) a belt operatively associated with the first and second support arms for securing a person supported by the weight bearing platforms, wherein the first support arm and the second support arm are rotatably movable between a first position where the weight bearing platforms are close enough for supporting a person and a second position where the first support arm and the second support arm are spaced sufficiently from each other for receiving the person between the weight bearing platforms; and (c) means for moving the lift assembly upwardly and downwardly relative to the base assembly.

11. An apparatus for lifting and moving a person, the lifting and moving apparatus comprising:

(a) a mobile base assembly;

(b) a lift assembly moveably mounted on the base assembly, the lift assembly comprising (i) a frame member moveably engaging the base assembly, (ii) a first support arm rotatably attached to the frame member for rotation in a first plane about an upwardly extending axis, the first support arm including a weight bearing platform adjacent a free distal end of the first support arm, the weight bearing platform operatively connected for rotation with the first support arm in a second plane spaced below the first plane, and (iii) a second support arm rotatably attached to the frame member laterally spaced from the first support arm for rotation in the first plane about an upwardly extending axis, the second support arm including a weight bearing platform adjacent a free distal end of the second support arm, the weight bearing platform operatively connected for rotation with the second support arm in the second plane, wherein the first support arm and the second support arm are rotatably movable between a first position where the weight bearing platforms are close enough for supporting a person and a second position where the first support arm and the second support arm are spaced sufficiently from each other for receiving the person between the weight bearing platforms;

(c) means for moving the lift assembly upwardly and downwardly relative to the base assembly; and (d) a safety bar rotatably attached to the frame member for movement between a first raised position and a second lowered position where the safety bar is adapted to at least partially surround the person supported by the weight bearing platforms.

12. A seat for a person for use with a lifting and moving apparatus including a mobile base assembly, and a lift assembly moveably mounted on the base assembly, and means for moving the lift assembly upwardly and downwardly relative to the base assembly, the seat comprising:

(a) a first support arm adapted to be rotatably attached to the lift assembly for rotation in a first plane about an upwardly extending axis, the first support arm including a weight bearing platform adjacent a free distal end of the first support arm, the weight bearing platform operatively connected for rotation with the first support arm in a second plane spaced below the first plane; and (b) a second support arm adapted to be rotatably attached to the lift assembly laterally spaced from the first support arm for rotation in the first plane about an upwardly extending axis, the second support arm including a weight bearing platform adjacent a free distal end of the second support arm, the weight bearing platform operatively connected for rotation with the second support arm in the second plane, wherein the first support arm and the second support arm are rotatably movable between a first position where the weight bearing platforms are close enough for supporting a person and a second position where the first support arm and the second support arm are spaced sufficiently from each other for receiving the person between the weight bearing platforms.

13. A lifting and moving apparatus as recited in claim 12, wherein the weight bearing platforms are covered with a padding.

14. A seat for a person for use with a lifting and moving apparatus including a mobile base assembly, and a lift assembly moveably mounted on the base assembly, and means for moving the lift assembly upwardly and downwardly relative to the base assembly, the seat comprising:

(a) a first support arm adapted to be rotatably attached to the lift assembly for rotation about an upwardly extending axis, the first support arm including a weight bearing platform adjacent a free distal end of the first support arm;

(b) a second support arm adapted to be rotatably attached to the lift assembly laterally spaced from the first support arm for rotation about an upwardly extending axis, the second support arm including a weight bearing platform adjacent a free distal end of the second support arm; and (c) a belt operatively associated with the first and second support arms for securing a person supported by the weight bearing platforms, wherein the first support arm and the second support arm are rotatably movable between a first position where the weight bearing platforms are close enough for supporting a person and a second position where the first support arm and the second support arm are spaced sufficiently from each other for receiving the person between the weight bearing platforms.

* * * * *